US011781289B2

(12) United States Patent
Zhang et al.

(10) Patent No.: US 11,781,289 B2
(45) Date of Patent: Oct. 10, 2023

(54) ELECTRO-HYDRAULIC DRIVE SYSTEM FOR A MACHINE

(71) Applicant: Parker-Hannifin Corporation, Cleveland, OH (US)

(72) Inventors: Hao Zhang, Twinsburg, OH (US); Blake Carl, Lyndhurst, OH (US); Dale Vanderlaan, Beachwood, OH (US); Germano Franzoni, Arlington Heights, IL (US)

(73) Assignee: Parker-Hannifin Corporation, Cleveland, OH (US)

( * ) Notice: Subject to any disclaimer, the term of this patent is extended or adjusted under 35 U.S.C. 154(b) by 35 days.

(21) Appl. No.: 17/617,042

(22) PCT Filed: Jun. 4, 2020

(86) PCT No.: PCT/US2020/036030

§ 371 (c)(1),
(2) Date: Dec. 7, 2021

(87) PCT Pub. No.: WO2021/029940

PCT Pub. Date: Feb. 18, 2021

(65) Prior Publication Data

US 2022/0259828 A1 Aug. 18, 2022

Related U.S. Application Data

(60) Provisional application No. 62/886,419, filed on Aug. 14, 2019.

(51) Int. Cl.
*E02F 9/22* (2006.01)

(52) U.S. Cl.
CPC ..... *E02F 9/2292* (2013.01); *E02F 9/2285* (2013.01); *E02F 9/2228* (2013.01); *E02F 9/2267* (2013.01); *E02F 9/2289* (2013.01)

(58) Field of Classification Search
CPC ..... E02F 9/2217; E02F 9/2289; E02F 9/2292
See application file for complete search history.

(56) References Cited

U.S. PATENT DOCUMENTS 8,910,474 B2 * 12/2014 Knussman ..... F15B 7/003 60/421
9,290,912 B2 3/2016 Wen et al.
(Continued)

FOREIGN PATENT DOCUMENTS

CN 103827512 A 5/2014
CN 107420357 A 12/2017
(Continued)

OTHER PUBLICATIONS

First Examination Report prepared by the Indian Patent Office in application No. 202117056973 dated Jun. 8, 2022.
(Continued)

*Primary Examiner* — Abiy Teka
(74) *Attorney, Agent, or Firm* — McDonnell Boehnen Hulbert & Berghoff LLP

(57) ABSTRACT

An example hydraulic system includes a hydraulic cylinder actuator comprising a cylinder and a piston, wherein the piston comprises a piston head and a rod extending from the piston head, wherein the piston head divides an internal space of the cylinder into a first chamber and a second chamber, and wherein the hydraulic cylinder actuator is unbalanced; a first pump driven by a first electric motor to provide fluid flow to the first chamber or the second chamber of the hydraulic cylinder actuator to drive the piston; a boost flow line; a hydraulic motor actuator; and a second pump driven by a second electric motor, wherein the second pump is fluidly coupled to the boost flow line to provide boost fluid flow to the hydraulic cylinder actuator.

20 Claims, 6 Drawing Sheets

(56) References Cited

U.S. PATENT DOCUMENTS

| | | | | |
|---|---|---|---|---|
| 9,829,013 | B2 * | 11/2017 | Cho | F15B 11/10 |
| 10,119,556 | B2 | 11/2018 | Peterson et al. | |
| 10,184,225 | B2 | 1/2019 | Hiraku et al. | |
| 10,202,741 | B2 | 2/2019 | Kang et al. | |
| 2003/0097837 | A1 * | 5/2003 | Hiraki | F15B 21/08 60/486 |
| 2013/0312399 | A1 * | 11/2013 | Hiraku | E02F 9/2217 60/422 |
| 2014/0283508 | A1 * | 9/2014 | Hiraku | E02F 9/2235 60/328 |

FOREIGN PATENT DOCUMENTS

| | | | |
|---|---|---|---|
| DE | 102011056894 | A1 | 11/2012 |
| JP | S59-86704 | A | 5/1984 |
| JP | 2006-105226 | A | 4/2006 |
| KR | 2015 0073046 | A | 6/2015 |
| WO | WO 2010/028100 | A1 | 3/2010 |
| WO | WO 2017/192303 | A1 | 11/2017 |

OTHER PUBLICATIONS

Notice of the Reason for Refusal prepared by the Japanese Patent Office in application No. 2021-577626 dated Jan. 10, 2023. English translation included.

International Search Report and Written Opinion prepared by the European Patent Office in application No. PCT/US2020/036030 dated Oct. 23, 2020.

First Office Action prepared by the Chinese Patent Office in application No. 2020800510525 dated Sep. 28, 2022.

* cited by examiner

ELECTRO-HYDRAULIC DRIVE SYSTEM FOR A MACHINE

CROSS REFERENCE TO RELATED APPLICATION

The present application claims priority to U.S. Provisional Application No. 62/886,419, filed on Aug. 14, 2019, which is hereby incorporated by reference in its entirety.

TECHNICAL FIELD

The invention relates generally to hydraulic actuation systems for extending and retracting at least one unbalanced hydraulic cylinder actuator in a work machine, where make-up or boost flow for a hydrostatic pump driving the at least one unbalanced hydraulic cylinder actuator is provided by another hydrostatic pump that drives another hydraulic actuator of the work machine, rather than by an additional dedicated boost system.

BACKGROUND

It is common for a work machine, such as but not limited to hydraulic excavators, wheel loaders, loading shovels, backhoe shovels, mining equipment, industrial machinery and the like, to have one or more actuated components such as lifting and/or tilting arms, booms, buckets, steering and turning functions, traveling means, etc. Commonly, in such machines, a prime mover drives a hydraulic pump for providing fluid to the actuators. Open-center or closed center valves control the flow of fluid to the actuators. Such valves are characterized by large power losses due to throttling flow therethrough. Further, such conventional systems may involve providing a constant amount of flow from a pump regardless of how many of the actuators is being used. Thus, such systems are characterized by poor efficiencies.

It may thus be desirable to have a hydraulic system that enhances efficiency of a work machine. It is with respect to these and other considerations that the disclosure made herein is presented.

SUMMARY

The present disclosure describes implementations that relate to an electro-hydraulic drive system for a machine.

In a first example implementation, the present disclosure describes a hydraulic system. The hydraulic system comprises: (i) a hydraulic cylinder actuator comprising a cylinder and a piston slidably accommodated in the cylinder, wherein the piston comprises a piston head and a rod extending from the piston head, wherein the piston head divides an internal space of the cylinder into a first chamber and a second chamber, and wherein the hydraulic cylinder actuator is unbalanced such that a first fluid flow rate of fluid provided to the first chamber or the second chamber to drive the piston in a given direction is different from a second fluid flow rate of fluid discharged from the other chamber as the piston moves; (ii) a first pump configured to be a bi-directional fluid flow source driven by a first electric motor in opposite rotational directions to provide fluid flow to the first chamber or the second chamber of the hydraulic cylinder actuator to drive the piston; (iii) a boost flow line configured to provide boost fluid flow or receive excess fluid flow comprising a difference between the first fluid flow rate and the second fluid flow rate; (iv) a hydraulic motor actuator; and (v) a second pump configured to be a respective bi-directional fluid flow source driven by a second electric motor and rotatable by the second electric motor in opposite directions to provide fluid flow to the hydraulic motor actuator, wherein the second pump is fluidly coupled to the boost flow line to provide the boost fluid flow to the hydraulic cylinder actuator.

In a second example implementation, the present disclosure describes a machine. The machine includes: (i) a plurality of hydraulic cylinder actuators, each hydraulic cylinder actuator of the plurality of hydraulic cylinder actuators comprising: a cylinder and a piston slidably accommodated in the cylinder, wherein the piston comprises a piston head and a rod extending from the piston head, wherein the piston head divides an internal space of the cylinder into a first chamber and a second chamber, wherein each hydraulic cylinder actuator is unbalanced such that a first fluid flow rate of fluid provided to the first chamber or the second chamber to drive the piston in a given direction is different from a second fluid flow rate of fluid discharged from the other chamber as the piston moves, and wherein each hydraulic cylinder actuator of the plurality of hydraulic cylinder actuators is operated by an electro-hydrostatic actuation system (EHA) comprising a respective pump configured to be a bi-directional fluid flow source driven by a respective electric motor in opposite rotational directions to provide fluid flow to the first chamber or the second chamber of a respective hydraulic cylinder actuator to drive the piston; (ii) a boost flow line configured to provide boost fluid flow or receive excess fluid flow comprising a difference between the first fluid flow rate and the second fluid flow rate; and (iii) a hydraulic motor actuator operated by a hydraulic motor EHA comprising: a pump configured to be a respective bi-directional fluid flow source driven by an electric motor and rotatable by the electric motor in opposite directions to provide fluid flow to the hydraulic motor actuator, wherein the pump is fluidly coupled to the boost flow line to provide the boost fluid flow to the respective hydraulic cylinder actuator.

In a third example implementation, the present disclosure describes a method. The method comprises: (i) receiving, at a controller of a hydraulic system, a request to extend a piston of a hydraulic cylinder actuator, wherein the hydraulic cylinder actuator comprises a cylinder in which the piston is slidably accommodated, wherein the piston comprises a piston head and a rod extending from the piston head, and wherein the piston head divides an internal space of the cylinder into a head side chamber and a rod side chamber; (ii) responsively, sending a first command signal to a first electric motor to drive a first pump to provide fluid flow via a first fluid flow line to the head side chamber and extend the piston, wherein the hydraulic cylinder actuator is unbalanced such that a first fluid flow rate of fluid provided to the head side chamber via the first fluid flow line to extend the piston is larger than a second fluid flow rate of fluid discharged from the rod side chamber as the piston extends and provide back to the first pump via a second fluid flow line; (iii) sending a second command signal to a second electric motor to drive a second pump, wherein the second pump is configured to be a bi-directional fluid flow source driven by the second electric motor and rotatable by the second electric motor in opposite directions to drive a hydraulic motor actuator; and (iv) providing boost fluid flow from the second pump via a boost flow line that fluidly couples the second pump to the second fluid flow line, such that the boost fluid flow joins fluid returning to the first pump via the second fluid flow line and makes up for a difference between the first fluid flow rate and the second fluid flow rate.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Figure 1:
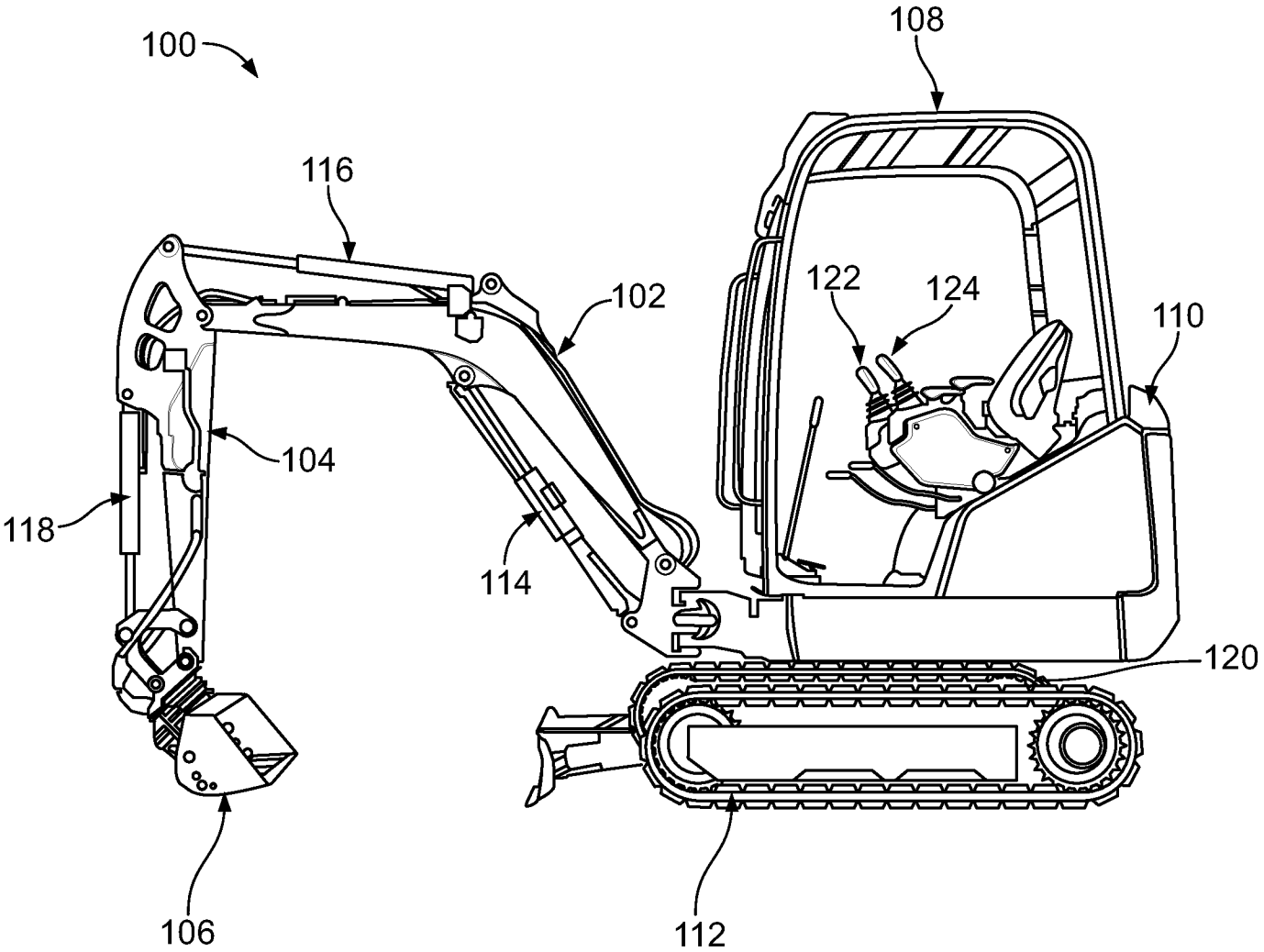
FIG. 1 illustrates an excavator, in accordance with an example implementation.

An example hydraulic machine such as an excavator can use multiple hydraulic actuators to accomplish a variety of tasks. In conventional systems, an engine drives one or more pumps that then provide pressurized fluid to chambers within the actuators. Pressurized fluid force acting on the actuator (e.g., piston) surface causes movement of actuators and connected work tools. Once the hydraulic energy is utilized, fluid is drained from the chambers to return to a low pressure reservoir.

Conventional systems include valves that throttle fluid being provided to the actuator and fluid returning from the actuator to the reservoir. Throttling fluid through the valve causes energy losses that reduce the efficiency of the hydraulic system over a course of a machine duty cycle. Another undesirable effect of fluid throttling is heating of the hydraulic fluid which results in increased cooling requirement and cost. Further, in some conventional systems involving open-center valves, one or more pumps provide a large amount of fluid flow that is sufficient to move all the actuators regardless of how many actuators are used by the operator of the machine at a particular point in the duty cycle. Excess fluid, not consumed by the actuators, is "dumped" to the reservoir. As an example, efficiency of such a hydraulic system can be as low as 20%. To enable the hydraulic machine to use less fuel per duty cycle, it may be desirable to enhance efficiency of the hydraulic machine. Having a more efficient hydraulic machine may also enable using an electric system having a rechargeable battery, rather than a traditional internal combustion engine-driven hydraulic machine To enhance efficiency of a hydraulic machine, conventional hydraulic system described above can be replaced with an electro-hydrostatic actuator system. An electro-hydrostatic actuator system can include a bi-directional, variable speed electric motor that is connected to a hydrostatic pump for providing fluid to an actuator such as a hydraulic cylinder for controlling motion of the actuator. The speed and direction of the electric motor controls the flow of fluid to the actuator.

In a typical unbalanced (differential) hydraulic cylinder having a piston configured to move therein, the cross-sectional area of the piston on the head side of the piston is greater than the cross-sectional area of the piston on the rod side of the piston. When the piston extends, more fluid is needed to fill the hydraulic cylinder chamber having the head side of the piston than is being discharged from the hydraulic cylinder chamber having the rod side of the piston. Conversely, less fluid is needed to fill the rod side chamber than is being discharged from the head side chamber when the piston retracts.

To make up for the difference in flow, a dedicated, additional flow boost pump can be used to provide the flow difference. Having a dedicated, additional pump can increase cost and complexity of the hydraulic system. It may thus be desirable to have a hydraulic system that avoids using an additional boost pump as disclosed herein.

FIG. 1 illustrates an excavator 100, in accordance with an example implementation. The excavator 100 can include a boom 102, an arm 104, bucket 106, and cab 108 mounted to a rotating platform 110. The rotating platform 110 can sit atop an undercarriage with wheels or tracks such as track 112. The arm 104 can also be referred to as a dipper or stick.

Movement of the boom 102, the arm 104, the bucket 106, and the rotating platform 110 can be achieved through the use of hydraulic fluid, with hydraulic cylinders and hydraulic motors. Particularly, the boom 102 can be moved with a boom hydraulic cylinder actuator 114, the arm 104 can be moved with an arm hydraulic cylinder actuator 116, and the bucket 106 can be moved with a bucket hydraulic cylinder actuator 118.

The rotating platform 110 can be rotated by a swing drive. The swing drive can include a slew ring or a swing gear to which the rotating platform 110 is mounted. The swing drive can also include a swing hydraulic motor actuator 120 (see also FIG. 3) disposed under the rotating platform 110 and coupled to a gear box. The gear box can be configured to have a pinion that is engaged with teeth of the swing gear. As such, actuating the swing hydraulic motor actuator 120 with pressurized fluid causes the swing hydraulic motor actuator 120 to rotate the pinion of the gear box, thereby rotating the rotating platform 110.

The cab 108 can include control tools for the operator of the excavator 100. For instance, the excavator 100 can include a drive-by-wire system have a right joystick 122 and a left joystick 124 that can be used by the operator to provide electric signals to a controller of the excavator 100. The controller then provides electric command signals to various electrically-actuated components of the excavator 100 to drive the various actuators mentioned above and operate the excavator 100. As an example, the left joystick 124 can operate the arm hydraulic cylinder actuator 116 and the swing hydraulic motor actuator 120, whereas the right joystick 122 can operate the boom hydraulic cylinder actuator 114 and the bucket hydraulic cylinder actuator 118.

To enhance efficiency of the hydraulic system driving the actuators of the excavator 100, an electro-hydrostatic system disclosed herein can be used, rather than conventional pump and throttle valve systems.

Figure 2:
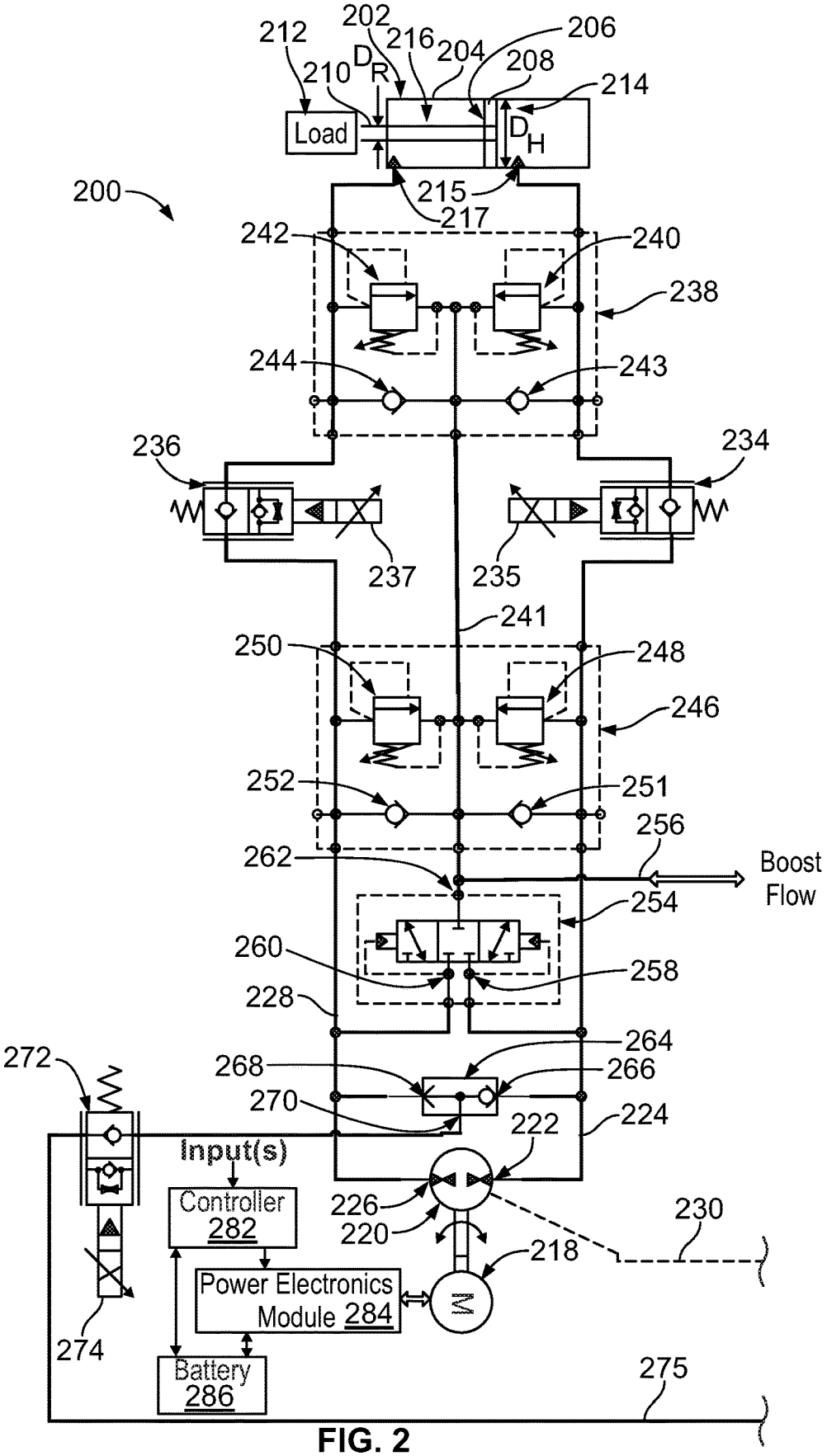
FIG. 2 illustrates an electro-hydrostatic actuator system for driving a hydraulic cylinder actuator, in accordance with an example implementation.
Figure 2:
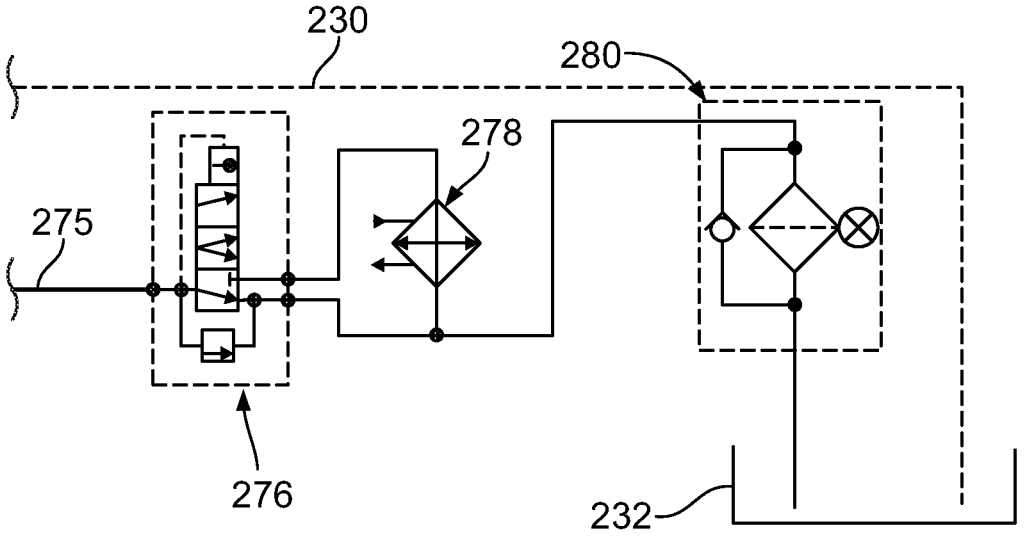

FIG. 2 illustrates an electro-hydrostatic actuator system (EHA) 200, in accordance with an example implementation. The EHA 200 can be used to drive any type of actuator such as a hydraulic cylinder actuator 202 as depicted in FIG. 2. The hydraulic cylinder actuator 202 can represent any cylinder actuator of the boom hydraulic cylinder actuator 114, the arm hydraulic cylinder actuator 116, or the bucket hydraulic cylinder actuator 118, for example. However, the EHA 200 can also be used to drive hydraulic motor actuators such as the swing hydraulic motor actuator 120.

The hydraulic cylinder actuator 202 includes a cylinder 204 and a piston 206 slidably accommodated in the cylinder 204 and configured to move in a linear direction therein. The piston 206 includes a piston head 208 and a rod 210 extending from the piston head 208 along a central longitudinal axis direction of the cylinder 204. The rod 210 is coupled to a load 212 (that represents, for example, the boom 102, the arm 104, or the bucket 106 and any forces applied thereto). The piston head 208 divides the internal space of the cylinder 204 into a first chamber 214 and a second chamber 216.

The first chamber 214 can be referred to as head side chamber as the fluid therein interacts with the piston head 208, and the second chamber 216 can be referred to as rod side chamber as the rod 210 is disposed partially therein. Fluid can flow to and from the first chamber 214 through a workport 215, and can flow to and from the second chamber 216 through a workport 217.

The piston head 208 can have a diameter DH, whereas the rod 210 can have a diameter DR. As such, fluid in the first chamber 214 interacts with a cross-sectional surface area of piston head 208 that can be referred to as piston head area and is equal to $$A_H = \pi\frac{D_H^2}{4}.$$

On the other hand, fluid in the second chamber 216 interacts with an annular surface area of the piston 206 that can be referred to as piston annular $$areaA_{Annular} = \pi\frac{D_H^2 - D_R^2}{4}.$$

The area $A_{Annular}$ is smaller than the piston head area $A_H$. As such, as the piston 206 extends (e.g., moves to the left in FIG. 2) or retracts (e.g., moves to the right in FIG. 2) within the cylinder 204, the amount of fluid flow $Q_H$ going into or being discharged from the first chamber 214 is greater than the amount of fluid flow $Q_{Annular}$ being discharged from or going into the second chamber 216. Particularly, if the piston 206 is moving at a particular velocity V then $Q_H=A_HV$ is greater than $Q_{Annular}=A_{Annular}V$. The difference in flow can be determined as $Q_H-Q_{Annular}=A_RV$, where $A_R$ is the cross-sectional area of the rod 210 and is equal to $$\pi\frac{D_R^2}{4}.$$

With this configuration, the hydraulic cylinder actuator 202 can be referred to as an unbalanced actuator as fluid flow to/from one chamber thereof is not equal to fluid flow to/from the other chamber.

The EHA 200 is configured to control the rate and direction of hydraulic fluid flow to the hydraulic cylinder actuator 202. Such control is achieved by controlling the speed and direction of an electric motor 218 used to drive a pump 220 configured as a bi-directional fluid flow source. The pump 220 has a first pump port 222 connected by a fluid flow line 224 to the first chamber 214 of the hydraulic cylinder actuator 202 and a second pump port 226 connected by a fluid flow line 228 to the second chamber 216 of the hydraulic cylinder actuator 202. The term "fluid flow line" is used throughout herein to indicate one or more fluid passages, conduits or the like that provide the indicated connectivity.

The first pump port 222 and the second pump port 226 are configured to be both inlet and outlet ports based on direction of rotation of the electric motor 218 and the pump 220. As such, the electric motor 218 and the pump 220 can rotate in a first rotational direction to withdraw fluid from the first pump port 222 and pump fluid to the second pump port 226, or conversely rotate in a second rotational direction to withdraw fluid from the second pump port 226 and pump fluid to the first pump port 222.

As depicted in FIG. 2, the pump 220 and the hydraulic cylinder actuator 202 are configured in a closed loop hydraulic circuit. Particularly, fluid is being recirculated in a loop between the pump 220 and the hydraulic cylinder actuator 202 rather than in an open loop circuit where a pump draws fluid from a reservoir and fluid then return to the reservoir. Rather, in the EHA 200, the pump 220 provides fluid through the first pump port 222 to the workport 215 or through the second pump port 226 to the workport 217, and fluid being discharged from the other workport returns to the corresponding port of the pump 220. As such, fluid is being recirculated between the pump 220 and the hydraulic cylinder actuator 202.

In an example, the pump 220 can be a fixed displacement pump and the amount of fluid flow provided by the pump 220 is controlled by the speed of the electric motor 218 (i.e., by rotational speed of an output shaft of the electric motor 218 coupled to an input shaft of the pump 220). For example, the pump 220 can be configured to have a particular pump displacement $P_D$ that determines the amount of fluid generated or provided by the pump 220 in, for example, cubic inches per revolution ($in^3$/rev). The electric motor 218 can be running at a commanded speed having units of revolutions per minute (RPM). As such, multiplying the speed of the electric motor 218 by $P_D$ determines the fluid flow rate Q in cubic inches per minute ($in^3$/min) provided by the pump 220 to the hydraulic cylinder actuator 202.

The flow rate Q in turn determines the linear speed of the piston 206. For instance, if the electric motor 218 is rotating the pump 220 is a first rotational direction to provide fluid to the first chamber 214, the piston 206 can extend at a speed $$V_1 = \frac{Q}{A_H}.$$

On the other hand, if the electric motor 218 is rotating the pump 220 is a second rotational direction to provide fluid to the second chamber 216, the piston 206 can retract at a speed $$V_2 = \frac{Q}{A_{Annular}}.$$

As depicted in FIG. 2, a housing or case of the pump 220 can be drained via a drain leakage line 230 that is fluidly coupled to a reservoir 232. The case of the pump 220 can thus be drained freely through the drain leakage line 230 to reduce internal pressure of the pump 220, particularly when the pump 220 is rotated quickly to a high rotational speed, thereby ensuring long life for the pump shaft seal.

The EHA 200 further includes a first load-holding valve 234 disposed in the fluid flow line 224 between the first pump port 222 and the workport 215. The EHA 200 also includes a second load-holding valve 236 disposed in the fluid flow line 228 between the second pump port 226 and the workport 217. The load-holding valves 234, 236 are configured as pressure control valves that prevent the piston 206 from moving (i.e., prevent the load 212 from dropping) in an uncontrolled manner. In particular, the load-holding valves 234, 236 are configured to operate as check valves that allow free flow from the pump 220 to the chambers 214, 216 while blocking fluid flow from the chambers 214, 216 back the pump 220 until actuated. The term "block" is used throughout herein to indicate substantially preventing fluid flow except for minimal or leakage flow of drops per minute, for example.

As an example, the load-holding valves 234, 236 can have solenoid actuators comprising solenoid coils 235, 237 respectively, that when energized cause a moving element (e.g., a poppet) within the respective load-holding valves 234, 236 to move and allow fluid flow from the respective chamber 214, 216 to the pump 220. For instance, to extend the piston 206, the pump 220 can provide fluid flow from the first pump port 222 through the load-holding valve 234 (which is unactuated) to the first chamber 214 through the workport 215. Fluid being discharged from the second chamber 216 is blocked by the load-holding valve 236 until the load-holding valve 236 is actuated by energizing the solenoid coil 237 to open a fluid flow path from the second chamber 216 to the second pump port 226.

Conversely to retract the piston 206, the pump 220 can provide fluid flow from the second pump port 226 through the load-holding valve 236 (which is unactuated) to the second chamber 216 through the workport 217. Fluid being discharged from the first chamber 214 is blocked by the load-holding valve 234 until the load-holding valve 234 is actuated by energizing the solenoid coil 235 to open a fluid flow path from the first chamber 214 to the first pump port 222.

In an example, the load-holding valves 234, 236 can be on/off valves that fully open upon actuation. In another example, it may be desirable to control pressure level of fluid in the chamber (either of the chambers 216, 216) from which fluid is being discharged. In this example, the load-holding valves 236, 236 can be configured as proportional valves that can be modulated to have a particular size opening therethrough that achieves a particular back pressure in the respective chamber from which fluid is being discharged.

In some cases, the hydraulic cylinder actuator 202 can be subjected to a large force caused by the load 212 (e.g., the bucket 106 hits a hard rock during a digging cycle) that causes over-pressurization in either of the chambers 216, 216 as the load-holding valves 234, 236 block fluid flow from the chambers 214, 216. To protect the cylinder 204 from the possibility of over-pressurization in the event that an excessive external overload is applied to the piston 206, the EHA 200 includes a workport pressure relief valve assembly 238 disposed between the load-holding valves 234, 236 and the hydraulic cylinder actuator 202.

The workport pressure relief valve assembly 238 can include a pressure relief valve 240 configured to protect the first chamber 214 and connected between the fluid flow line 224 and a common fluid flow line 241. The workport pressure relief valve assembly 238 can also include a pressure relief valve 242 configured to protect the second chamber 216 and connected between the fluid flow line 228 and the common fluid flow line 241. The pressure relief valves 240, 242 are configured to open and provide a fluid flow path to the common fluid flow line 241 (which is fluid coupled to boost flow line 256 as described below) when pressure level of fluid in the respective chamber 214, 216 exceeds a threshold pressure value, such as 300 bar or 4350 pounds per square inch (psi).

The workport pressure relief valve assembly 238 can further include anti-cavitation check valves 243, 244 disposed in parallel with the pressure relief valves 240, 242, respectively. The anti-cavitation check valves 243, 244 are configured to prevent or reduce the likelihood of cavitation in either of the chambers 214, 216. Particularly, the anti-cavitation check valves 243, 244 provide fluid flow paths from the common fluid flow line 241 to the chambers 214, 216 when pressure level of fluid in the chambers 214, 216 drops below pressure level of fluid in the common fluid flow line 241.

Further, the pump 220 can also be subjected to over-pressurization at the pump ports 222, 226. For example, the pump ports 222, 226 can be subjected to over-pressurization if both load-holding valves 234, 236 are momentarily actuated together while the pump 220 is running or if pressure levels in either of the chambers 214, 216 increases substantially due to an overload situation while the corresponding load-holding valve is actuated). To protect the pump 220 from the possibility of over-pressurization, the EHA 200 may also include a pump pressure relief valve assembly 246 disposed between the pump 220 and the load-holding valves 234, 236.

The pump pressure relief valve assembly 246 can include a pressure relief valve 248 configured to protect the first pump port 222 and connected between the fluid flow line 224 and the common fluid flow line 241. The pump pressure relief valve assembly 246 can also include a pressure relief valve 250 configured to protect the second pump port 226 and connected between the fluid flow line 228 and the common fluid flow line 241. The pressure relief valves 248, 250 are configured to open and provide a fluid flow path to the common fluid flow line 241 when pressure level of fluid in the fluid flow lines 224, 228 exceeds a threshold pressure value such as 250 bar or 3625 psi. As such, in an example, pressure settings of the pressure relief valves 248, 250 can be lower than respective pressure settings of the pressure relief valves 240, 242.

The pump pressure relief valve assembly 246 can further include anti-cavitation check valves 251, 252 disposed in parallel with the pressure relief valves 248, 250, respectively. The anti-cavitation check valves 251, 252 are configured to prevent or reduce the likelihood of cavitation at either of the pump ports 222, 226. Particularly, the anti-cavitation check valves 251, 252 provide fluid flow paths from the common fluid flow line 241 to the pump ports 222, 226 via the fluid flow lines 224, 228 when pressure level at the pump ports 222, 226 is below pressure level of fluid in the common fluid flow line 241.

As mentioned above, the hydraulic cylinder actuator 202 is unbalanced such that the amount of fluid flow rate provided to or discharged from the first chamber 214 is greater than the amount of fluid flow rate provided to or discharged from the second chamber 216. As such, the amount of fluid flow rate provided from or received at the first pump port 222 to or from the first chamber 214 is greater than the amount of fluid flow rate provided from or received at the second pump port 226 to or from the second chamber 216. Such discrepancy between the fluid flow rate provided by the pump 220 and fluid flow rate received thereat can cause cavitation and the pump 220 might not operate properly. The EHA 200 provides for a configuration to boost the fluid flow rate to make up for such discrepancy in fluid flow rate.

Particularly, the EHA 200 can include a reverse shuttle valve 254 configured to fluidly couple the chambers 214, 216 of the cylinder 204 to the common fluid flow line 241, which is connected to a make-up or boost flow line 256. The reverse shuttle valve 254 is configured to be responsive to pressure difference across the pump 220 (i.e., pressure difference between the first fluid flow line 224 and the second fluid flow line 228).

In an example, the reverse shuttle valve 254 can be configured as a pilot-operated, three-position shuttle valve having a shuttle element therein (e.g., a poppet or spool) the position of which is determined by differential pressure across the pump 220. The reverse shuttle valve 254 can have a first pilot port 258 fluidly coupled to the fluid flow line 224 and a second pilot port 260 fluidly coupled to the fluid flow line 228.

The reverse shuttle valve 254 also has a third or boost port 262 fluidly coupled to the boost flow line 256 via the common fluid flow line 241. The reverse shuttle valve 254 is operated by differential pressure between the fluid flow lines 224 and 228 to: (i) connect the fluid flow line 228 to the common fluid flow line 241 when pressure in the fluid flow line 224 exceeds the pressure level in the fluid flow line 228 by a predetermined amount to supply make-up or boost fluid through the common fluid flow line 241 to the fluid flow line 228, and (ii) connect the fluid flow line 224 to the common fluid flow line 241 when pressure in the fluid flow line 228 exceeds the pressure level in the fluid flow line 224 by a predetermined amount such that excess fluid from the first chamber 214 can be received by the common fluid flow line 241 and provided to the boost flow line 256.

Specifically, if the pump 220 is driven by the electric motor 218 to supply fluid to the fluid flow line 224 for extension of the piston 206, the pressure differential across the pump 220 shifts the shuttle element of the reverse shuttle valve 254 to connect the boost port 262 to the pilot port 260, thereby fluidly coupling the fluid flow line 228 to the common fluid flow line 241 (and the boost flow line 256) while blocking flow from the fluid flow line 224 to the common fluid flow line 241. As such, the reverse shuttle valve 254 provides a fluid flow path from the boost flow line 256 to the pump port 226 to make up for the difference between flow rate of fluid provided to the first chamber 214 and flow rate of fluid returning through the fluid flow line 228 from the second chamber 216.

Conversely, when the pump 220 is driven in the opposite direction to retract the piston 206, the pressure differential across the pump 220 shifts the shuttle element of the reverse shuttle valve 254 to connect the pilot port 258 to the boost port 262, thereby fluidly coupling the fluid flow line 224 to the common fluid flow line 241 while blocking flow from the fluid flow line 228 to the common fluid flow line 241. This way, the reverse shuttle valve 254 provides a fluid flow path for the excess flow of fluid returning through the fluid flow line 224 from the first chamber 214 to the boost flow line 256.

With this configuration, the reverse shuttle valve 254 is configured such that when one of the fluid flow lines 224, 228 is disconnected from the common fluid flow line 241, the other fluid flow line is connected, thereby reducing if not eliminating the possibility of hydraulic lock-up of the piston 206.

The term "reverse" is ascribed to the reverse shuttle valve 254 as it differs from a traditional shuttle valve. A traditional shuttle valve may have a first inlet, a second inlet, and an outlet. A valve element moves freely within such traditional shuttle valve such that when pressure from fluid is exerted through a particular inlet, it pushes the valve element toward the opposite inlet. This movement may block the opposite inlet, while allowing the fluid to flow from the particular inlet to the outlet. This way, two different fluid sources can provide pressurized fluid to an outlet without back flow from one source to the other. The reverse shuttle valve 254 does not have a designated outlet port, but rather either provides fluid flow from the boost port 262 to the pilot port 260 or provide fluid flow from the pilot port 258 to the boost port 262.

In the example configuration described above, the reverse shuttle valve 254 is a pilot-operated valve where the shuttle element moves in response to differential pressure between the fluid flow lines 224, 228. In other examples, the reverse shuttle valve 254 can be electrically-actuated such that an electric controller (e.g., controller 282 described below) of the EHA 200 can provide electric signals that move the shuttle element based on sensed pressure levels in the fluid flow lines 224, 228.

In some examples, the pump 220 can be more efficient when it is run by the electric motor 218 above a particular threshold speed (e.g., above 500 RPM). However, under some operating conditions, it may be desirable to extend or retract the piston 206 at a linear speed that is achievable with a small amount of flow rate below what the pump 220 supplies at the particular threshold speed. In these examples and operating conditions, it may be desirable to operate the pump 220 at the particular threshold speed to operate the pump 220 efficiently, while providing excess flow not consumed by the hydraulic cylinder actuator 202 to the reservoir 232.

For example, the EHA 200 can include a shuttle valve 264 that is disposed in parallel with the pump 220. The shuttle valve 264 can have a first inlet port 266 fluidly coupled to the fluid flow line 224, a second inlet port 268 fluidly coupled to the fluid flow line 228, and an outlet port 270. The shuttle valve 264 can have a shuttle element therein that is movable based on pressure differential between the inlet ports 266, 268. If pressure level in the fluid flow line 224 is higher than pressure level in the fluid flow line 228, fluid can be provided from the inlet port 266 to the outlet port 270. Conversely, if pressure level in the fluid flow line 224 is less than pressure level in the fluid flow line 228, fluid can be provided from the inlet port 268 to the outlet port 270.

The EHA 200 can further include a bypass valve 272. The bypass valve 272 can be configured, for example, as an electrically-actuated normally-closed valve. When the bypass valve 272 is unactuated, it blocks fluid flow from the outlet port 270 of the shuttle valve 264. On the other hand, if a command signal is provided to a solenoid coil 274 of the bypass valve 272, the bypass valve 272 opens to provide a fluid flow path from the outlet port 270 to the reservoir 232.

As such, in the examples and operating conditions where the pump 220 supplies more fluid flow than the amount of fluid flow rate that achieves a slow extension speed command for the piston 206, the bypass valve 272 is actuated such that excess flow can be provided from the fluid flow line 224 through the inlet port 266 to the outlet port 270, then through the bypass valve 272 to the reservoir 232. Similarly, in the examples and operating conditions where the pump 220 supplies more fluid flow than the amount of fluid flow rate that achieves a slow retraction speed command for the piston 206, the bypass valve 272 is actuated such that excess flow can be provided from the fluid flow line 228 through the inlet port 268 to the outlet port 270, then through the bypass valve 272 to the reservoir 232.

In examples, the EHA 200 can include a thermal relief valve 276 fluidly coupled to the bypass valve 272 via a fluid flow line 275. If temperature of fluid in the fluid flow line 275 rises such that pressure of fluid in the fluid flow line 275 exceeds a particular value, the thermal relief valve 276 can open to relieve the fluid in the fluid flow line 275 to reduce pressure level therein. In examples, the EHA 200 can also include a heat exchanger 278 for extracting heat from the hydraulic fluid and a filter assembly 280 for filtering the fluid before return to the reservoir 232.

As depicted in FIG. 2, the EHA 200 can include a controller 282. The controller 282 can include one or more processors or microprocessors and may include data storage (e.g., memory, transitory computer-readable medium, non-transitory computer-readable medium, etc.). The data storage may have stored thereon instructions that, when executed by the one or more processors of the controller 282, cause the controller 282 to perform operations described herein.

The controller 282 can receive input information comprising sensor information via signals from various sensors or input devices, and in response provide electrical signals to various components of the EHA 200. For example, the controller 282 can receive a command or an input (e.g., from the joysticks 122, 124 of the excavator 100) to move the piston 206 in a given direction at a particular desired speed (e.g., to extend or retract the piston 206). The controller 282 can also receive sensor information indicative of one or more position of speed of the piston 206, pressure levels in various hydraulic lines, chambers, or ports of the EHA 200, magnitude of the load 212, etc. Responsively, the controller 282 can provide command signals to the electric motor 218 via power electronics module 284 and to the solenoid coil 235 or the solenoid coil 237 to move the piston 206 in the commanded direction and at a desired commanded speed in a controlled manner. Command signals lines from the controller 282 to the solenoid coils 235, 237, and 274 are not shown in FIG. 2 to reduce visual clutter in the drawing. However, it should be understood that the controller 282 is electrically-coupled (e.g., via wires or wireless) to various solenoid coils, input devices, sensors, etc. of the EHA 200 and the excavator 100.

The power electronics module 284 can comprise, for example, an inverter having an arrangement of semiconductor switching elements (transistors) that can support conversion of direct current (DC) electric power provided from a battery 286 of the excavator 100 to three-phase electric power capable of driving the electric motor 218. The battery 286 can also be electrically-coupled to the controller 282 to provide power thereto and receive commands therefrom. In other examples, if the excavator 100 is propelled by an internal combustion engine (ICE) rather than being electrically propelled via the battery 286, an electric generator can be coupled to the ICE to generate power to the power electronics module 284.

To extend the piston 206 (i.e., move the piston 206 to the left in FIG. 2), the controller 282 can send a command signal to the power electronics module 284 to operate the electric motor 218 and rotate the pump 220 in a first rotational direction. Fluid is thus provided from the pump port 222 through the fluid flow line 224 and through the load-holding valve 234, which is unactuated, to the first chamber 214 to extend the piston 206.

To allow fluid to flow from the second chamber 216 to the pump port 226, the controller 282 sends a command signal to the solenoid coil 237 of the load-holding valve 236 to actuate it and open a fluid flow path from the second chamber 216 to the pump port 226. Pressurized fluid provided by the pump 220 through the fluid flow line 224 shifts the shuttle element of the reverse shuttle valve 254 to connect the boost flow line 256 to the fluid flow line 228 to provide make-up or boost flow that joins fluid discharged from the second chamber 216 before flowing together to the pump port 226. The make-up of boost flow $Q_{Boost}$ is determined as $Q_{Boost}=A_R V$, where $A_R$ is the cross-sectional area of the rod 210 and V is the speed of the piston 206 as mentioned above.

As such, the amount of flow rate provided to the pump port 226 is substantially equal to the amount of flow rate provided by the pump 220 through the pump port 222 and the fluid flow line 224 to the first chamber 214. Notably, the fluid returning through the fluid flow line 228 to the pump port 226 from the chamber 216 has a low pressure level, and therefore, the boost flow can be provided at a low pressure level that matches the low pressure level of flow returning to the pump port 226. For example, the boost flow can have a pressure level in the range of 10-35 bar or 145-500 psi, compared to high pressure levels such as 4500 psi that might be provided by the pump 220 to the first chamber 214 to extend the piston 206 against the load 212, assuming the load 212 is resistive.

To retract the piston 206 (i.e., move the piston 206 to the right in FIG. 2), the controller 282 can send a command signal to the power electronics module 284 to operate the electric motor 218 and rotate the pump 220 in a second rotational direction, opposite the first rotational direction. Fluid is thus provided from the pump port 226 through the fluid flow line 228 and through the load-holding valve 236, which is unactuated, to the second chamber 216 to retract the piston 206.

To allow fluid to flow from the first chamber 214 to the pump port 222, the controller 282 sends a command signal to the solenoid coil 235 of the load-holding valve 234 to actuate it and open a fluid path from the first chamber 214 to the pump port 222. Pressurized fluid provided by the pump 220 through the fluid flow line 228 shifts the shuttle element of the reverse shuttle valve 254 to connect the fluid flow line 224 to the boost flow line 256, thereby providing excess flow returning from the first chamber 214 to the boost flow line 256. The excess flow can be determined as $Q_{Excess}=A_R V$. As such, the amount of flow rate of fluid returning to the pump port 222 from the first chamber 214 is substantially equal to the amount of flow provided by the pump 220 through the pump port 226 and the fluid flow line 228 to the second chamber 216, while excess flow from the first chamber 214 is provided to the boost flow line 256.

In an example, a dedicated boost system, which can include an additional boost pump and associated fluid connections, can be used to provide fluid to the boost flow line 256 and receive excess fluid flow therefrom. Such a dedicated boost system adds cost and complexity to a hydraulic system.

Further, in a conventional machine driven by an ICE, the ICE is typically run at a constant speed, and the boost pump would be directly coupled to the ICE, thereby continually providing fluid flow even when not needed by the actuators. Such unneeded fluid flow wastes energy, rendering the machine inefficient.

In an electrical machine (e.g., driven by a battery) having a boost pump driven by an electric motor adds cost of a dedicated electric motor and power electronics associated with the boost pump to the cost of the machine. As such, it may be desirable to configure the hydraulic system of the machine without a dedicated boost system, but rather configure the hydraulic system in a manner that utilizes existing pumps and motors to provide the boost flow, thereby reducing the cost of the system and increasing its efficiency.

Figure 3:
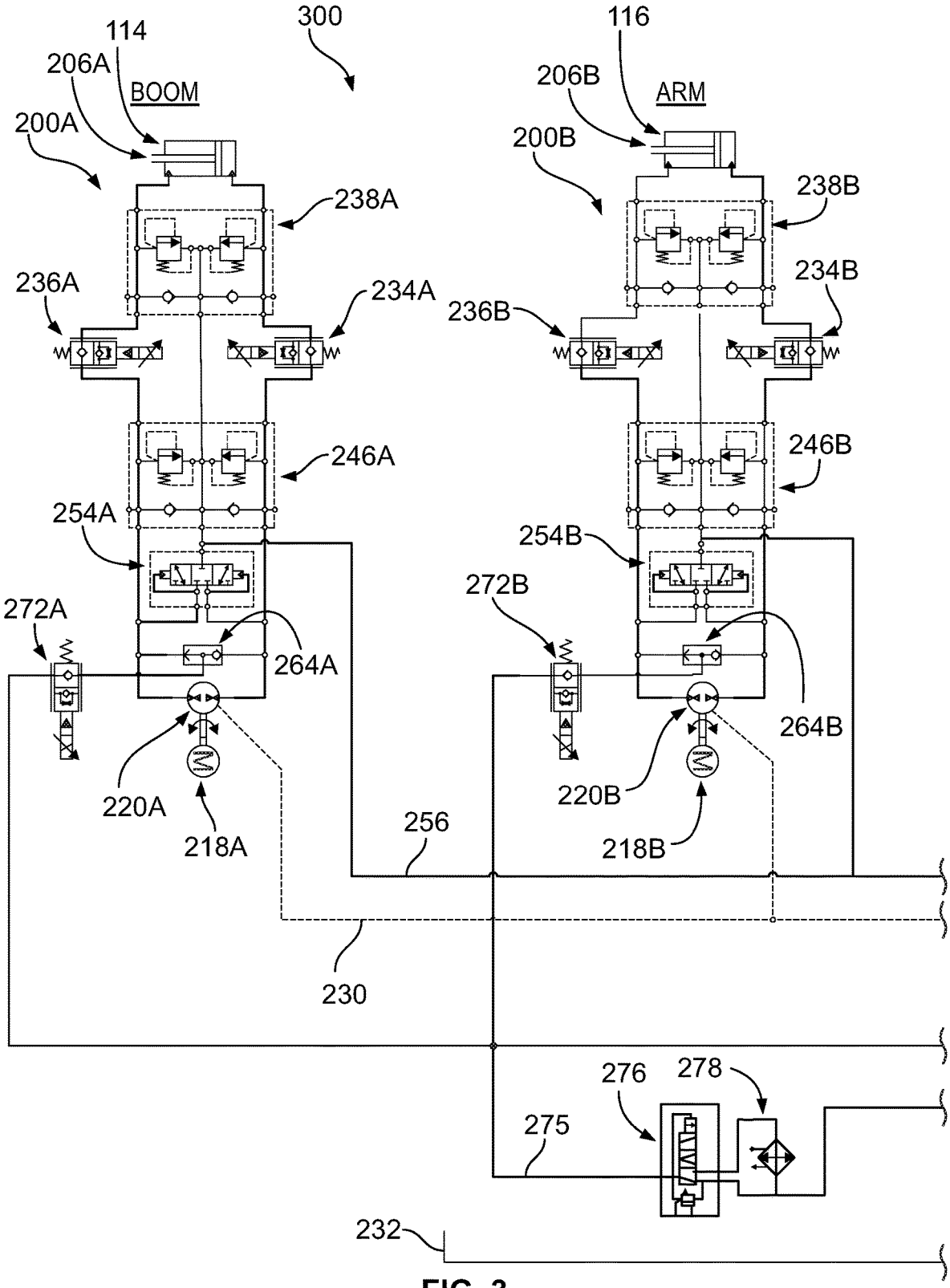
FIG. 3 illustrates a hydraulic system of an excavator, in accordance with an example implementation.
Figure 3:
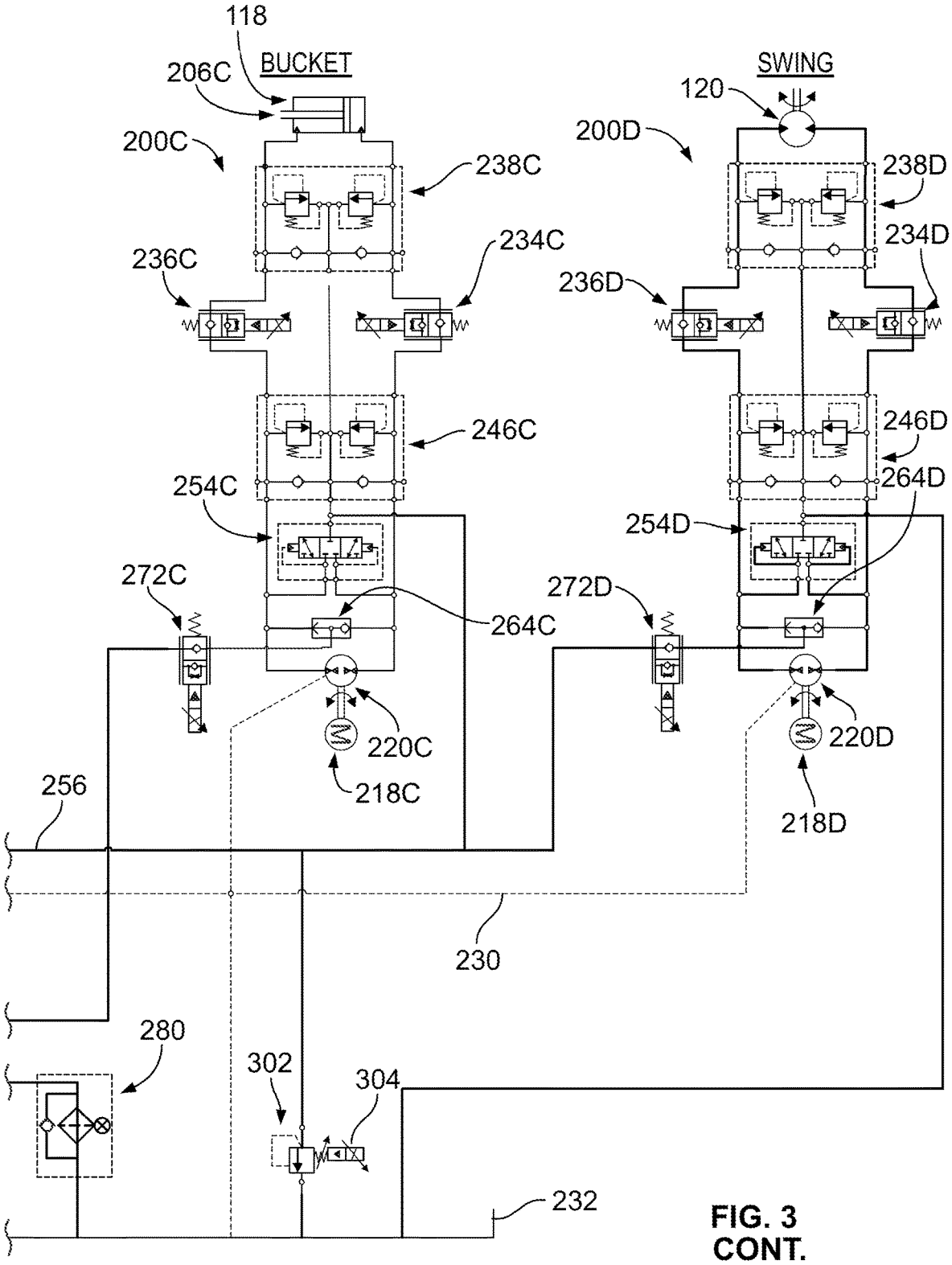

FIG. 3 illustrates a hydraulic system 300 of the excavator 100, in accordance with an example implementation. The hydraulic system 300 includes EHAs 200A, 200B, 200C, and 200D that control the various actuators of the excavator 100. Particularly, the EHAs 200A-200C are hydraulic cylinder EHAs such that the EHA 200A controls the boom hydraulic cylinder actuator 114, the EHA 200B controls the arm hydraulic cylinder actuator 116, and the EHA 200C controls the bucket hydraulic cylinder actuator 118, whereas and the EHA 200D is a hydraulic motor EHA that controls the swing hydraulic motor actuator 120.

The EHAs 200A, 200B, 200C, and 200D comprise the same components of the EHA 200 described above with respect to FIG. 2. Therefore, the components or elements of the EHAs 200A, 200B, 200C, and 200D are designated with the same reference numbers used for the EHA 200 with an "A," "B," "C," or "D" suffix to correspond to the EHAs 200A, 200B, 200C, and 200D respectively. Components of the EHAs 200A, 200B, 200C, and 200D operate in a similar manner to components of the EHA 200 as described above.

Further, the controller 282, the power electronics module 284, and the battery 286 are not shown in FIG. 3 to reduce visual clutter in the drawings. However, it should be understood that the hydraulic system 300 includes a controller such as the controller 282 configured to operate and actuate the various components of the hydraulic system 300 in a similar manner to the controller 282. Also, it should be understood that the electric motors 218A, 218B, 218C, and 218D are driven or controlled by respective power electronics modules similar to the power electronics module 284. A battery similar to the battery 286 can also power the various components and modules of the hydraulic system 300.

The hydraulic system 300 is configured such that, rather than having a dedicated boost system that can provide boost flow to the unbalanced actuators, the swing pump 220D is configured to operate the boost system to provide the boost flow. Particularly, while the bypass valves 272A, 272B, 272C of the EHAs 200A, 200B, 200C are fluidly coupled to the reservoir 232 via the fluid flow line 275, the bypass valve 272D of the EHA 200D of the swing hydraulic motor actuator 120 is fluidly coupled to the boost flow line 256.

With this configuration, if boost flow is requested by any of the unbalanced actuators, the controller of the excavator 100 can command the bypass valve 272D to open and command the electric motor 218D to rotate the swing pump 220D and provide boost fluid flow through the shuttle valve 264D and the bypass valve 272D to the boost flow line 256. In particular, the controller can determine the amount of flow rate requested by the unbalanced actuators and command the electric motor 218D to rotate at a particular speed that generates the requested amount of fluid flow rate requested.

Further, the hydraulic system 300 allows excess flow returning from some of the unbalanced actuators whose pistons is retracting to be used by other unbalanced actuators whose pistons are extending. For example, if a first piston of a first actuator is retracting and thus excess flow is provided to the boost flow line 256 from the first actuator, while a second piston of a second actuator is extending and thus consumes boost flow from the boost flow line 256, the excess flow from the first actuator can be provided to the second actuator via the boost flow line 256.

As mentioned above, boost fluid flow joins the return flow having low pressure level (e.g., 10-35 bar). In an example, to provide boost fluid flow at a particular pressure level substantially equal to pressure level in the return flow, the hydraulic system 300 can include an electro-hydraulic pressure relief valve (EHPRV) 302 configured to control pressure level of fluid in the boost flow line 256.

The EHPRV 302 fluidly couples the boost flow line 256 to the reservoir 232 as shown in FIG. 3. The EHPRV 302 can, for example, include a mechanical relief portion and an electrohydraulic proportional portion having a solenoid coil 304. As an example, the mechanical relief portion can have a movable element (e.g., a poppet) that is biased by a spring to be seated at a seat formed within a valve body or sleeve in the EHPRV 302. The spring determines a pressure setting of the EHPRV 302.

When pressure level of fluid in the boost flow line 256 exceeds a particular pressure level, i.e., the pressure setting of the EHPRV 302, the movable member overcomes the spring and is lifted off a seat, thereby causing fluid to flow from the boost flow line 256 to the reservoir 232. As a result, pressure level in the boost flow line 256 does not exceed the pressure setting of the EHPRV 302.

The electrohydraulic proportional portion of the EHPRV 302 can include, for example, a proportional two way valve. When an electric signal is provided to the solenoid coil 304, a spool or movable element in the electrohydraulic proportional portion moves and allows a fluid signal to be provided to the mechanical relief portion. The fluid signal varies the pressure setting determined by the spring of the mechanical relief portion based on a magnitude of the electrical signal supplied to the solenoid coil 304. As the magnitude of the signal is increased, for example, the pressure setting increases and vice versa. With this configuration, the pressure level of the boost fluid flow provided by the swing pump 220D to the boost flow line 256 can be controlled and varied by the electric signal to the solenoid coil 304.

As an example scenario to describe operation of the hydraulic system 300, it is assumed that the operator of the excavator 100 uses the joysticks 122, 124 to request extending the piston 206A of the boom hydraulic cylinder actuator 114 and retract the piston 206B of the arm hydraulic cylinder actuator 116. The controller (e.g., the controller 282) of the hydraulic system 300 receives from the joysticks 122, 124 signals indicative of the operator's commands. In response, the controller can convert the magnitude of the joystick command signals to requested speeds for the pistons 206A, 206B and accordingly determine the amounts of fluid flow rates that achieve the requested speeds.

Based on the displacements of the pumps 220A, 220B, which can be stored on a memory of the controller, the controller provides motor command signals to the electric motors 218A, 218B to rotate at respective rotational speeds, and thus rotate the pumps 220A, 220B at the respective rotational speeds to provide the determined amounts of fluid flow rates. The electric motors 218A, 218B can rotate in opposite rotational directions as the piston 206A, 206B are to move in opposite directions.

The controller further actuates the load-holding valve 236A of the EHA 200A to allow fluid discharged from the rod side chamber of the boom hydraulic cylinder actuator 114 to flow therethrough back to boom pump 220A. The controller also actuates the load-holding valves 234B of the EHA 200B to allow fluid discharged from the head side chamber of the arm hydraulic cylinder actuator 116 to flow therethrough back to the pump 220B.

Because the piston 206A is extending, boost flow is drawn from the boost flow line 256 through the reverse shuttle valve 254A to join returning fluid from the rod side chamber before flowing together to the boom pump 220A. Assuming that the commanded velocity for the piston 206A is $V_{Boom}$ and the cross-sectional area of the rod of the piston 206A is $A_{Rod_Boom}$, the boost flow rate can be determined by the controller to be $V_{Boom} \cdot A_{Rod_Boom}$. On the other hand, because the piston 206B is retracting, excess flow is provided to the boost flow line 256 through the reverse shuttle valve 254B. Assuming that the commanded velocity for the piston 206B is $V_{Arm}$ and the cross-sectional area of the rod of the piston 206B is $A_{Rod_Arm}$, the excess flow rate can be determined by the controller to be $V_{Arm} \cdot A_{Rod_Arm}$.

The controller can determine whether the excess flow rate from the arm hydraulic cylinder actuator 116 is equal to or greater than the boost flow rate requested by the boom hydraulic cylinder actuator 114 such that the excess flow rate provided to the boost flow line 256 is sufficient to meet the boost flow rate requested by the boom hydraulic cylinder actuator 114. If the excess flow rate is not equal to or greater than the requested boost flow rate, the controller can actuate the electric motor 218D to drive the swing pump 220D and provide the difference in flow rate.

Particularly, if the operator does not command via the joysticks 122, 124 the rotating platform 110 to rotate, the load-holding valves 234D, 236D of the EHA 200D are not actuated. Thus, the controller can actuate the electric motor 218D to rotate in either direction and drive the swing pump 220D to provide fluid flow that is equal to the difference between $V_{Boom} \cdot A_{Rod_Boom}$ and $V_{Arm} \cdot A_{Rod_Arm}$.

Fluid flowing from the swing pump 220D is not consumed by the swing hydraulic motor actuator 120 because the load-holding valves 234D, 236D are not actuated. Thus, fluid flowing from the swing pump 220D is provided to one of the inlet ports of the shuttle valve 264D, shifting its shuttle element and flowing to its outlet port. The controller further actuates the bypass valve 272D of the EHA 200D to allow fluid to flow from the outlet port of the shuttle valve 264D to the boost flow line 256, then to the reverse shuttle valve 254A of the EHA 200A to make up for the difference between $V_{Boom} \cdot A_{Rod_Boom}$ and $V_{Arm} \cdot A_{Rod_Arm}$. The controller can further provide an electric command signal to the EHPRV 302 to maintain a particular pressure level in the boost flow line 256 that is substantially equal to pressure level of fluid returning to the boom pump 220A.

In an alternative scenario, the operator may command rotation of the rotating platform 110 at the same time of commanding movement of the boom hydraulic cylinder actuator 114 and the arm hydraulic cylinder actuator 116. For instance, the operator can use the joysticks 122, 124 to command rotation of the rotating platform 110 at a particular rotational speed $\omega_{Swing}$. Based on displacement of the swing hydraulic motor actuator 120 and the commanded speed $\omega_{Swing}$, the controller determines an amount of fluid flow rate $Q_{swing}$ to be provided to the swing hydraulic motor actuator 120 and achieve the speed $\omega_{Swing}$ and actuates one of the load-holding valves 234D, 236D based on the commanded direction of rotation of the rotating platform 110.

In this case, the controller determines the total amount of fluid flow rate $Q_{Total}$ to be supplied by the swing pump 220D to be equal to $\omega_{Swing}$ in addition to the difference in flow between $V_{Boom} \cdot A_{Rod_Boom}$ and $V_{Arm} \cdot A_{Rod_Arm}$. The controller then commands the electric motor 218D to rotate at a speed that causes the swing pump 220D to provide the total amount of fluid flow rate $Q_{Total}$ determined by the controller. The controller further actuates and modulates the bypass valve 272D and the load-holding valve 234D or 236D to apportion fluid flow from the swing pump 220D between the swing hydraulic motor actuator 120 and the boost flow for the boom hydraulic cylinder actuator 114 (i.e., the difference between $V_{Boom} \cdot A_{Rod_Boom}$ and $V_{Arm} \cdot A_{Rod_Arm}$). This way, a portion of the fluid provided by the swing pump 220D is consumed by the swing hydraulic motor actuator 120 to drive the rotating platform 110, and another portion is provided through the shuttle valve 264D and the bypass valve 272D to the boost flow line 256 to be consumed by the boom hydraulic cylinder actuator 114.

Notably, unlike the unbalanced actuators of the boom 102, the arm 104, and the bucket 106, the swing hydraulic motor actuator 120 of the rotating platform 110 is balanced and does not request boost flow or provide excess flow when operated. Thus, fluid flow provided through one port of the swing pump 220D is equal to fluid flow provided back to the other port of the swing pump 220D.

In some cases, the total flow rate $Q_{Total}$ requested for the boost flow line 256 in addition to the fluid flow rate requested by the swing hydraulic motor actuator 120 to achieve the speed $\omega_{Swing}$ can exceed the maximum allowed fluid flow rate $Q_{Max}$ that the swing pump 220D can supply based on its pump displacement and maximum allowed motor speed of the electric motor 218D. In these cases, the controller can determine a speed reduction factor equal to $$\frac{Q_{Max}}{Q_{Total}},$$

which results in a value less than 1. The controller can then multiply the speed command $V_{Boom}$ for the piston 206A and the swing command $\omega_{Swing}$ for the swing hydraulic motor actuator 120 by the speed reduction factor to determine modified commands $V_{Boom_Modified}$ and $\Omega_{Swing_Modified}$ that are less than the original commands $V_{Boom}$ and $\Omega_{Swing}$, respectively. The controller can then use the modified commands to determine the amounts of fluid flow rate requested for the boost flow line 256 and the swing hydraulic motor actuator 120, such that these amounts would not exceed that maximum allowed flow rate $Q_{Max}$ of the swing pump 220D.

The scenarios provided above are examples for illustrations. It should be understood that other scenarios involving actuation of the boom 102, the arm 104, the bucket 106, and the rotating platform 110 in different ways can be managed by the controller in a similar manner to the scenarios discussed above.

With this configuration, operating the excavator 100 does not involve using a dedicated boost system. Rather, the EHA 200D of the rotating platform 110, and particularly the swing pump 220D, can operate as a boost system in addition to being configured to operate the swing hydraulic motor actuator 120. This way, cost and complexity of the hydraulic system 300 may be lower than other systems involving an additional, dedicated boost system involving respective pump, motor, valves, and hydraulic lines.

Figure 4:
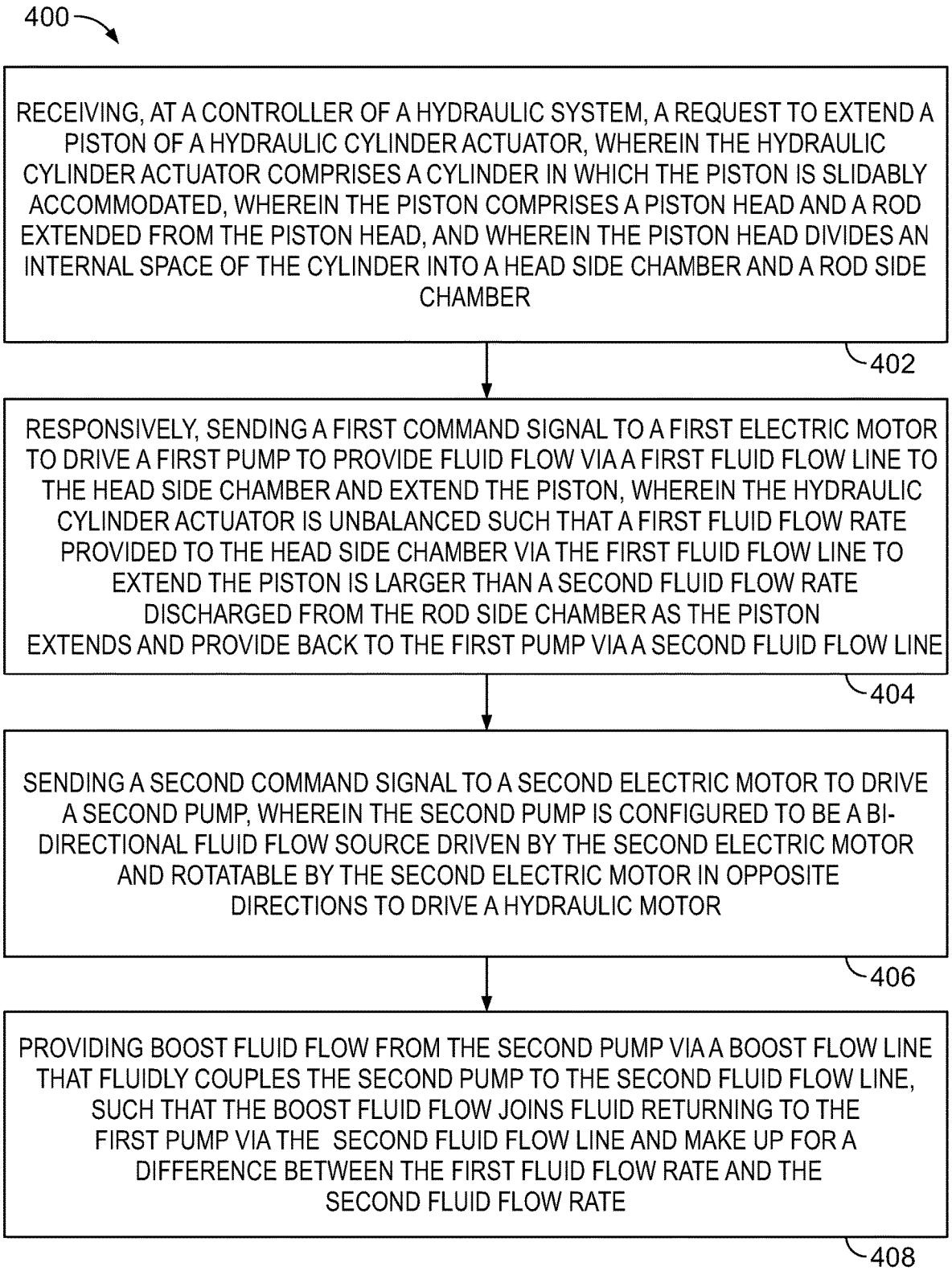
FIG. 4 is a flowchart of a method for operating a hydraulic system, in accordance with an example implementation.

FIG. 4 is a flowchart of a method 400 for operating the hydraulic system 300, in accordance with an example implementation.

The method 400 may include one or more operations, or actions as illustrated by one or more of blocks 402-408.

Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 402, the method 400 includes receiving, at a controller (e.g., the controller 282) of a hydraulic system (e.g., the hydraulic system 300), a request to extend a piston (e.g., the piston 206A) of a hydraulic cylinder actuator (e.g., the boom hydraulic cylinder actuator 114), wherein the hydraulic cylinder actuator comprises a cylinder (e.g., the cylinder 204) in which the piston is slidably accommodated, wherein the piston comprises a piston head (e.g., the piston head 208) and a rod (e.g., the rod 210) extending from the piston head, and wherein the piston head divides an internal space of the cylinder into a head side chamber (e.g., the chamber 214) and a rod side chamber (e.g., the chamber 216).

At block 404, the method 400 includes responsively, sending a first command signal to first electric motor (e.g., the electric motor 218A) to drive a first pump (e.g., the boom pump 220A) to provide fluid flow via a first fluid flow line (e.g., the fluid flow line 224) to the head side chamber and extend the piston, wherein the hydraulic cylinder actuator is unbalanced such that a first fluid flow rate of fluid provided to the head side chamber via the first fluid flow line to extend the piston is larger than a second fluid flow rate of fluid discharged from the rod side chamber as the piston extends and provide back to the first pump via a second fluid flow line (e.g., the fluid flow line 228).

At block 406, the method 400 includes sending a second command signal to a second electric motor (e.g., the electric motor 218D) to drive a second pump (e.g., the swing pump 220D), wherein the second pump is configured to be a bi-directional fluid flow source driven by the second electric motor and rotatable by the second electric motor in opposite directions to drive a hydraulic motor actuator (e.g., the swing hydraulic motor actuator 120).

At block 408, the method 400 includes providing boost fluid flow from the second pump via the boost flow line 256 that fluidly couples the second pump to the second fluid flow line, such that the boost fluid flow joins fluid returning to the first pump via the second fluid flow line and makes up for a difference between the first fluid flow rate and the second fluid flow rate. The controller can also send a third command signal to the bypass valve 272D to open the bypass valve 272D and allow fluid to flow from the second pump through the boost flow line to the second fluid flow line.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" or "about" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A hydraulic system comprising:

a hydraulic cylinder actuator comprising a cylinder and a piston slidably accommodated in the cylinder, wherein the piston comprises a piston head and a rod extending from the piston head, wherein the piston head divides an internal space of the cylinder into a first chamber and a second chamber, and wherein the hydraulic cylinder actuator is unbalanced such that a first fluid flow rate of fluid provided to the first chamber or the second chamber to drive the piston in a given direction is different from a second fluid flow rate of fluid discharged from the other chamber as the piston moves;

a first pump configured to be a bi-directional fluid flow source driven by a first electric motor in opposite rotational directions to provide fluid flow to the first chamber or the second chamber of the hydraulic cylinder actuator to drive the piston;

a boost flow line configured to provide boost fluid flow or receive excess fluid flow comprising a difference between the first fluid flow rate and the second fluid flow rate;

a hydraulic motor actuator; and a second pump configured to be a respective bi-directional fluid flow source driven by a second electric motor and rotatable by the second electric motor in opposite directions to provide fluid flow to the hydraulic motor actuator, wherein the second pump is fluidly coupled to the boost flow line to provide all of the boost fluid flow by the second pump to the hydraulic cylinder actuator.

2. The hydraulic system of claim 1, wherein the first pump has (i) a first pump port fluidly coupled to the first chamber via a first fluid flow line, and (ii) a second pump port fluidly coupled to the second chamber via a second fluid flow line, the hydraulic system further comprising:

a reverse shuttle valve having (i) a first pilot port fluidly coupled to the first fluid flow line, (ii) a second pilot port fluidly coupled to the second fluid flow line, and (iii) a boost port fluidly coupled to the boost flow line, wherein the reverse shuttle valve is responsive to pressure difference between the first fluid flow line and the second fluid flow line.

3. The hydraulic system of claim 2, wherein:

when pressure level in the first fluid flow line is higher than pressure level in the second fluid flow line, a shuttle element of the reverse shuttle valve shifts therein to fluidly couple the boost port to the second pilot port to provide the boost fluid flow to the second fluid flow line, and when pressure level in the second fluid flow line is higher than pressure level in the first fluid flow line, the shuttle element of the reverse shuttle valve shifts therein to fluidly couple the first pilot port to the boost port to provide the excess fluid flow from the first fluid flow line to the boost flow line.

4. The hydraulic system of claim 2, further comprising:

a first load-holding valve disposed in the first fluid flow line between the first pump port and the first chamber of the hydraulic cylinder actuator, wherein the first load-holding valve is configured to allow fluid flow from the first pump port to the first chamber while blocking fluid flow from the first chamber to the first pump port until actuated; and a second load-holding valve disposed in the second fluid flow line between the second pump port and the second chamber of the hydraulic cylinder actuator, wherein the second load-holding valve is configured to allow fluid flow from the second pump port to the second chamber while blocking fluid flow from the second chamber to the second pump port until actuated.

5. The hydraulic system of claim 4, further comprising:

a workport pressure relief valve assembly comprising: (i) a first pressure relief valve disposed between the first load-holding valve and the first chamber and configured to provide a fluid flow path from the first chamber to the boost flow line when pressure level of fluid in the first chamber exceeds a threshold pressure value, and (ii) a second pressure relief valve disposed between the second load-holding valve and the second chamber and configured to provide a respective fluid flow path from the second chamber to the boost flow line when pressure level of fluid in the second chamber exceeds the threshold pressure value.

6. The hydraulic system of claim 4, further comprising:

a pump pressure relief valve assembly comprising: (i) a first pressure relief valve disposed between the first pump port and the first load-holding valve and configured to provide a fluid flow path from the first pump port to the boost flow line when pressure level of fluid at the first pump port exceeds a threshold pressure value, and (ii) a second pressure relief valve disposed between the second pump port and the second load-holding valve and configured to provide a respective fluid flow path from the second pump port to the boost flow line when pressure level of fluid at the second pump port exceeds the threshold pressure value.

7. The hydraulic system of claim 1, wherein the second pump has (i) a first pump port fluidly coupled to the hydraulic motor actuator via a first fluid flow line, and (ii) a second pump port fluidly coupled to the hydraulic motor actuator via a second fluid flow line, the hydraulic system further comprising:

a shuttle valve disposed in parallel with the second pump and having (i) a first inlet port fluidly coupled to the first fluid flow line, (ii) a second inlet port fluidly coupled to the second fluid flow line, and (iii) an outlet port fluidly coupled to the boost flow line, wherein the shuttle valve is responsive to pressure difference between the first inlet port and the second inlet port, such that whether the second pump rotates in a first rotational direction to provide fluid to the first fluid flow line or in a second rotational direction to provide the fluid to the second fluid flow line, the fluid flows to the outlet port of the shuttle valve, then to the boost flow line.

8. The hydraulic system of claim 7, further comprising:

a bypass valve disposed in the boost flow line, wherein the bypass valve is an electrically-actuated normally-closed valve configured to block fluid flow from the outlet port of the shuttle valve until actuated by an electric command signal.

9. A machine comprising:

a plurality of hydraulic cylinder actuators, each hydraulic cylinder actuator of the plurality of hydraulic cylinder actuators comprising: a cylinder and a piston slidably accommodated in the cylinder, wherein the piston comprises a piston head and a rod extending from the piston head, wherein the piston head divides an internal space of the cylinder into a first chamber and a second chamber, wherein each hydraulic cylinder actuator is unbalanced such that a first fluid flow rate of fluid provided to the first chamber or the second chamber to drive the piston in a given direction is different from a second fluid flow rate of fluid discharged from the other chamber as the piston moves, and wherein each hydraulic cylinder actuator of the plurality of hydraulic cylinder actuators is operated by an electro-hydrostatic actuation system (EHA) comprising a respective pump configured to be a bi-directional fluid flow source driven by a respective electric motor in opposite rotational directions to provide fluid flow to the first chamber or the second chamber of a respective hydraulic cylinder actuator to drive the piston;

a boost flow line configured to provide boost fluid flow or receive excess fluid flow comprising a difference between the first fluid flow rate and the second fluid flow rate; and a hydraulic motor actuator operated by a hydraulic motor EHA comprising: a pump configured to be a respective bi-directional fluid flow source driven by an electric motor and rotatable by the electric motor in opposite directions to provide fluid flow to the hydraulic motor actuator, wherein the pump is fluidly coupled to the boost flow line to provide all of the boost fluid flow by the pump to the respective hydraulic cylinder actuator.

10. The machine of claim 9, wherein the machine is an excavator having a boom, an arm, a bucket, and a rotating platform, wherein the plurality of hydraulic cylinder actuators comprise: a boom hydraulic cylinder actuator, an arm hydraulic cylinder actuator, and a bucket hydraulic cylinder actuator, and wherein the hydraulic motor actuator is a swing hydraulic motor actuator configured to rotate the rotating platform.

11. The machine of claim 9, wherein the respective pump has (i) a first pump port fluidly coupled to the first chamber via a first fluid flow line, and (ii) a second pump port fluidly coupled to the second chamber via a second fluid flow line, and wherein the EHA of the respective hydraulic cylinder actuator further comprises:

a reverse shuttle valve having (i) a first pilot port fluidly coupled to the first fluid flow line, (ii) a second pilot port fluidly coupled to the second fluid flow line, and (iii) a boost port fluidly coupled to the boost flow line, wherein the reverse shuttle valve is responsive to pressure difference between the first fluid flow line and the second fluid flow line, wherein:

when pressure level in the first fluid flow line is higher than pressure level in the second fluid flow line, a shuttle element of the reverse shuttle valve shifts therein to fluidly couple the boost port to the second pilot port to provide the boost fluid flow to the second fluid flow line, and when pressure level in the second fluid flow line is higher than pressure level in the first fluid flow line, the shuttle element of the reverse shuttle valve shifts therein to fluidly couple the first pilot port to the boost port to provide the excess fluid flow from the first fluid flow line to the boost flow line.

12. The machine of claim 11, wherein the EHA further comprises:

a first load-holding valve disposed in the first fluid flow line between the first pump port and the first chamber of the respective hydraulic cylinder actuator, wherein the first load-holding valve is configured to allow fluid flow from the first pump port to the first chamber while blocking fluid flow from the first chamber to the first pump port until actuated; and a second load-holding valve disposed in the second fluid flow line between the second pump port and the second chamber of the respective hydraulic cylinder actuator, wherein the second load-holding valve is configured to allow fluid flow from the second pump port to the second chamber while blocking fluid flow from the second chamber to the second pump port until actuated.

13. The machine of claim 12, wherein the EHA further comprises:

a workport pressure relief valve assembly comprising: (i) a first pressure relief valve disposed between the first load-holding valve and the first chamber and configured to provide a fluid flow path from the first chamber to the boost flow line when pressure level of fluid in the first chamber exceeds a threshold pressure value, and (ii) a second pressure relief valve disposed between the second load-holding valve and the second chamber and configured to provide a respective fluid flow path from the second chamber to the boost flow line when pressure level of fluid in the second chamber exceeds the threshold pressure value.

14. The machine of claim 12, wherein the EHA further comprises:

a pump pressure relief valve assembly comprising: (i) a first pressure relief valve disposed between the first pump port and the first load-holding valve and configured to provide a fluid flow path from the first pump port to the boost flow line when pressure level of fluid at the first pump port exceeds a threshold pressure value, and (ii) a second pressure relief valve disposed between the second pump port and the second load-holding valve and configured to provide a respective fluid flow path from the second pump port to the boost flow line when pressure level of fluid at the second pump port exceeds the threshold pressure value.

15. The machine of claim 9, wherein the pump that drives the hydraulic motor actuator has (i) a first pump port fluidly coupled to the hydraulic motor actuator via a first fluid flow line, and (ii) a second pump port fluidly coupled to the hydraulic motor actuator via a second fluid flow line, wherein the hydraulic motor EHA further comprises:

a shuttle valve disposed in parallel with the pump and having (i) a first inlet port fluidly coupled to the first fluid flow line, (ii) a second inlet port fluidly coupled to the second fluid flow line, and (iii) an outlet port fluidly coupled to the boost flow line, wherein the shuttle valve is responsive to pressure difference between the first inlet port and the second inlet port, such that whether the pump rotates in a first rotational direction to provide fluid to the first fluid flow line or in a second rotational direction to provide the fluid to the second fluid flow line, the fluid flows to the outlet port of the shuttle valve, then to the boost flow line.

16. The machine of claim 15, further comprising:

a bypass valve disposed in the boost flow line, wherein the bypass valve is an electrically-actuated normally-closed valve configured to block fluid flow from the outlet port of the shuttle valve until actuated by an electric command signal.

17. The machine of claim 9, wherein the excess fluid flow from one of the plurality of hydraulic cylinder actuators is provided as a portion of the boost fluid flow for another hydraulic cylinder actuator of the plurality of hydraulic cylinder actuators via the boost flow line.

18. The machine of claim 9, further comprising:

respective power electronics modules configured to provide electric power to respective electric motors of the machine;

a controller configured to receive command signals indicative of requested speeds for respective pistons of the plurality of hydraulic cylinder actuators, and responsively provide corresponding command signals to the respective power electronics modules; and a battery configured to provide direct current electric power to the respective power electronics modules.

19. A method comprising:

receiving, at a controller of a hydraulic system, a request to extend a piston of a hydraulic cylinder actuator, wherein the hydraulic cylinder actuator comprises a cylinder in which the piston is slidably accommodated, wherein the piston comprises a piston head and a rod extending from the piston head, and wherein the piston head divides an internal space of the cylinder into a head side chamber and a rod side chamber;

responsively, sending a first command signal to a first electric motor to drive a first pump to provide fluid flow via a first fluid flow line to the head side chamber and extend the piston, wherein the hydraulic cylinder actuator is unbalanced such that a first fluid flow rate of fluid provided to the head side chamber via the first fluid flow line to extend the piston is larger than a second fluid flow rate of fluid discharged from the rod side chamber as the piston extends and provide back to the first pump via a second fluid flow line;

sending a second command signal to a second electric motor to drive a second pump, wherein the second pump is configured to be a bi-directional fluid flow source driven by the second electric motor and rotatable by the second electric motor in opposite directions to drive a hydraulic motor actuator; and providing all boost fluid flow from the second pump via a boost flow line that fluidly couples the second pump to the second fluid flow line, such that the boost fluid flow joins fluid returning to the first pump via the second fluid flow line and makes up for a difference between the first fluid flow rate and the second fluid flow rate.

20. The method of claim 19, wherein the hydraulic system comprises a bypass valve disposed in the boost flow line, wherein the bypass valve is an electrically-actuated normally-closed valve configured to block fluid flow from the second pump through the boost flow line when the bypass valve is unactuated, the method further comprising:

sending a third command signal to the bypass valve to open the bypass valve and allow fluid to flow from the second pump through the boost flow line to the second fluid flow line.

* * * * *